United States Patent [19]

Okami

[11] 4,233,877

[45] Nov. 18, 1980

[54] WIND SHIELD

[76] Inventor: Alvin S. Okami, 1915 Huina St., Honolulu, Hi. 96817

[21] Appl. No.: 69,393

[22] Filed: Aug. 24, 1979

[51] Int. Cl.[3] ..... G10D 9/00; G10G 7/00

[52] U.S. Cl. ..... 84/453; 84/384

[58] Field of Search ..... 84/380 R, 380 C, 384, 84/453

[56] References Cited

U.S. PATENT DOCUMENTS

| | | | |
|---|---|---|---|
| 801,086 | 10/1905 | Jenks | 84/384 |
| 1,704,147 | 3/1929 | Paulson | 84/384 |
| 2,637,239 | 5/1953 | Swanson | 84/384 |
| 3,062,084 | 11/1962 | Ogilvie | 84/384 |
| 3,599,526 | 8/1971 | Sollecito et al. | 84/384 |

FOREIGN PATENT DOCUMENTS

| | | | |
|---|---|---|---|
| 3182 | of 1808 | United Kingdom | 84/384 |
| 27318 | of 1904 | United Kingdom | 84/380 C |

*Primary Examiner*—Lawrence R. Franklin

*Attorney, Agent, or Firm*—George W. T. Loo

[57] ABSTRACT

A flute accessory that provides a protective shield around the embouchure hole area of a flute to enable a flutist to produce normal tones regardless of adverse outdoor conditions. Wind shield includes a top member, a front member, a bottom member, a left plate, and a right plate. Wind shield is attached to the barrel of a flute so that the left and right plates are equally spaced from the sides of the embouchure hole plate. Top member is joined by a bend to the front member. Front member is joined by a bend to the bottom member. Left and right plates are secured to the sides of the top and front members. The left and right plates each have a facing edge and a holding portion. The facing edges of the left and right plates and the free end of the top member are shaped to provide a comfortable fit when the device is placed against the face of a flutist. The barrel of a flute is retained within the holding portions by a rolling pin assembly and the bend at the juncture of the front and bottom members which acts as a hinge.

10 Claims, 12 Drawing Figures

WIND SHIELD

BACKGROUND OF THE INVENTION

1. Field of Invention

This invention relates to a flute accessory which shields out the wind from the embouchure hole area.

2. Description of the Prior Art

There are flute accessories to assist the proper placement of a flutist's lips in relation to the mouthpiece, but none to provide a windshield.

3. Disclosure Statement

Swanson, U.S. Pat. No. 2,637,239, dated May 5, 1953, discloses an embouchure arch which is used on the mouthpiece of a flute to assist beginners in holding the mouthpiece of the flute in the correct relationship to the lips for good tone production.

Sollecito, U.S. Pat. No. 3,599,526, dated Aug. 5, 1971, discloses an embouchure attachment for flute to insure the proper placement of embouchure relative to lower lip placement and blowing angle.

My invention provides a protective shield around the embouchure hole area of the flute to enable the flutist to produce tones regardless of adverse outdoor conditions. My invention protects the crucial tone production center area from being openly exposed to the elements and permits the flutist to produce tones as well as perform in a normal fashion even under negative outdoor circumstances.

My invention is disclosed in document entitled "Disclosure Document," No. 081067, received in U.S. Patent And Trademark Office on May 25, 1979.

SUMMARY OF THE INVENTION

This invention relates to a flute accessory which prevents wind and other extraneous outdoor elemental factors from affecting a flutist's ability to perform naturally and normally.

An object of this invention is to provide a flute accessory which will enable a flutist to produce normal tones regardless of adverse outdoor conditions.

Another object of this invention is to provide a flute accessory which will be a psychologically effective means of instilling confidence in a flutist whenever an outdoor performance is scheduled.

A further object of this invention is to provide a flute accessory which will envelope the mouth area of a flutist to prevent wind chapped lips during an outdoor performance.

A still further object of this invention is to provide a flute accessory which will prevent wind and other elemental factors from gaining entrance and interfering with the flow of air that passes from the mouth, through the aperture made by the lips, and into the embouchure hole of the flute.

Another object of this invention is to provide a flute accessory that allows the undisturbed passage and flow of air from a flutist's mouth to the embouchure hole of the flute.

Yet another object of this invention is to provide a flute accessory that is lightweight, attractive, and transparent, which can be readily attached to the mouthpiece of the flute whenever outdoor conditions warrant its use.

A still another object of this invention is to provide a flute accessory that is practical, feasible, economical, attractive, and durable.

Other objects, features and advantages of the present invention will be readily apparent from the following detailed description taken in connection with the accompanying drawings.

DESCRIPTION OF THE PREFERRED EMBODIMENTS

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
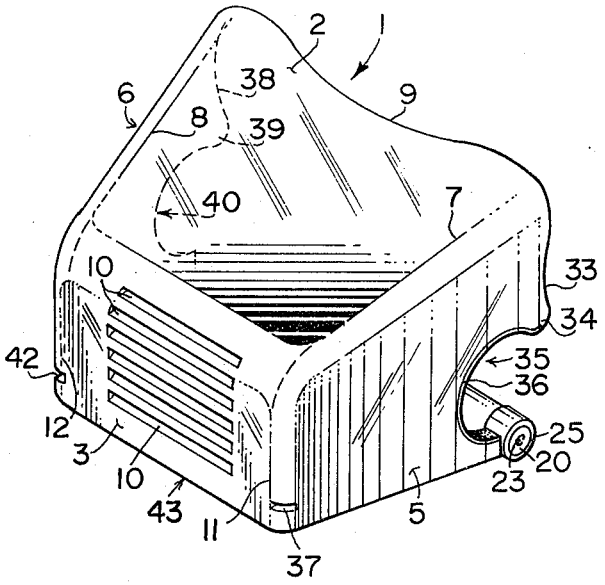
FIG. 1 is a perspective view of the preferred embodiment of the invention.
Figure 2:
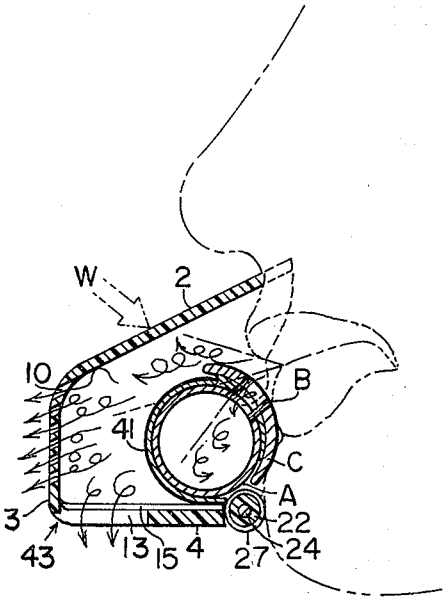
FIG. 2 is a sectional view of the invention taken on line 2—2 of FIG. 3 with the flute shown in cross section and a human outline of a face shown in phantom.
Figure 3:
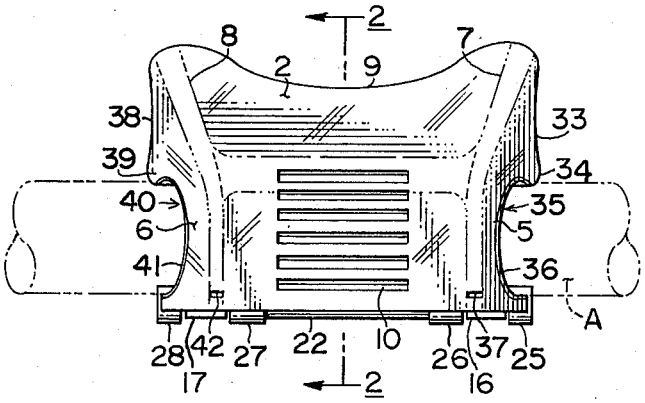
FIG. 3 is a front view of the invention illustrated in FIG. 1 with a flute outline shown in phantom.
Figure 4:
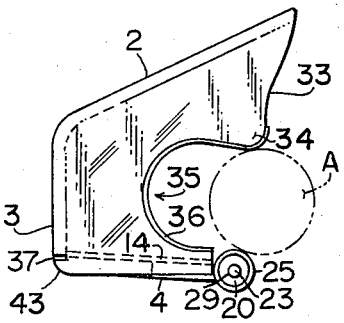
FIG. 4 is a left side view of the invention with a flute shown in phantom in the process of being mounted.
Figure 5:
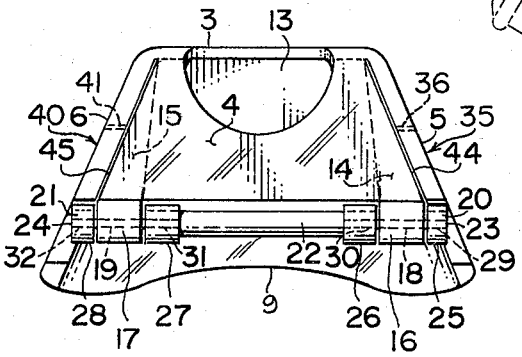
FIG. 5 is a bottom view of the invention.
Figure 6:
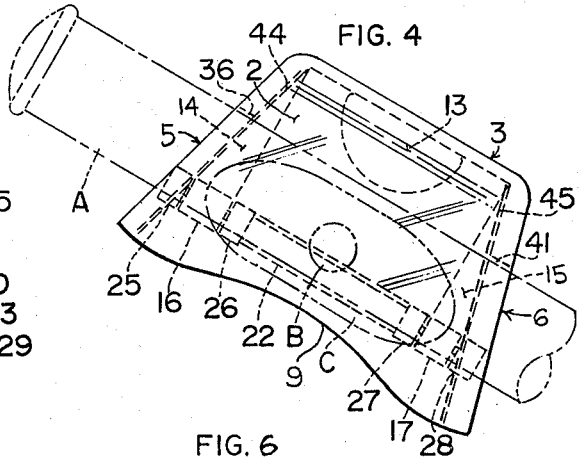
FIG. 6 is a top view of the invention with a flute outline shown in phantom to illustrate the position of the embouchure hole plate in relation to the invention.

Referring now to the drawings wherein like reference letters and numerals refer to like and corresponding parts throughout the several views, the preferred embodiment of the invention disclosed in FIGS. 1–6 inclusive is a wind shield 1. Reference letter A denotes the barrel of the flute, reference letter B denotes embouchure hole, and reference letter C denotes the embouchure hole plate.

Wind shield 1 includes a top member 2, a front member 3, a bottom member 4, a left plate 5, and a right plate 6. Top member 2 includes sides 7 and 8 and contour lip edge 9. Sides 7 and 8 converge towards each other.

Front member 3 includes slits 10 and sides 11 and 12. Sides 11 and 12 are parellel to each other. Slits 10 are made at a downward angle to allow for the passage of air and sound to pass through them from the inside and to impede the passage of wind and rain from the outside.

Bottom member 4 includes vent opening 13, sides 44 and 45, stiffeners 14 and 15, leaves 16 and 17, cylindrical openings 18 and 19, left wheel 20, right wheel 21, middle wheel 22, left axle 23, right axle 24, and protector rings 25, 26, 27, and 28. Protector ring 25 encircles left wheel 20; protector ring 28 encircles right wheel 21;

and protector rings 26 and 27 encircle the end portions of middle wheel 22.

An end portion of left axle 23 is secured within central opening 29 of left wheel 20. An end portion of right axle 24 is secured within central opening 32 of right wheel 21. Middle wheel 22 has cylindrical openings 30 and 31 in its end portions.

Left axle 23 passes through cylindrical openings 18 and 30. Right axle 24 passes through cylindrical openings 19 and 31. Left axle 23 and right axle 24 serve as axles for the three wheels 20, 21, and 22.

Stiffeners 14 and 15 are secured to the top of bottom member 4 and at its side borders. Leaves 16 and 17 are secured to the portions of stiffeners 14 and 15, respectively, which extend beyond the rear edge of bottom member 4. Stiffener 14 and leaf 16 form cylindrical opening 18. Stiffener 15 and leaf 17 form cylindrical opening 19.

Top member 2 is joined to front member 3 by a bend. Front member 3 is joined to bottom member 4 by a bend 43, which also serves as a hinge for bottom member 4.

Left plate 5 includes a facing edge 33, a bulge 34, holding portion 35, lining 36, and slit 37. Right plate 6 includes a facing edge 38, a bulge 39, holding portion 40, lining 41, and slit 42.

Facing edges 33 and 38 provide a comfortable fit when the device is pressed or placed against the mouth area. Bulges 34 and 39 aid in retaining barrel A in holding portions 35 and 40. Holding portion 35 is greater in diameter than holding portion 40 in order to compensate for the slightly conical shape of barrel A. Both holding portions 35 and 40 serve to receive barrel A in a snug and comfortable fit. Linings 36 and 41 serve to prevent abrasion and scratching of the silver finish of barrel A.

Slits 37 and 42 serve to stop capillary flow of liquid glue or cement from proceeding beyond the slits. They stop the capillary flow at a desired point to allow bottom member 4 to be free and moveable.

Left plate 5 is secured to sides 7 and 11. Right plate 6 is secured to sides 8 and 12. When glue or cement is used to secure left plate 5 and right plate 6 to the sides of top and front members, slits 37 and 42 allow the bottom member 4 to be free and moveable as they stop the capillary flow of the glue or cement at the slits. Bottom member 4 is free and moveable about bend 43. Slits 37 and 42 are located in a location which will allow the securing of left plate 5 and right plate 6 to the top member 2 and front member 3, but not to bottom member 4.

Figure 7:
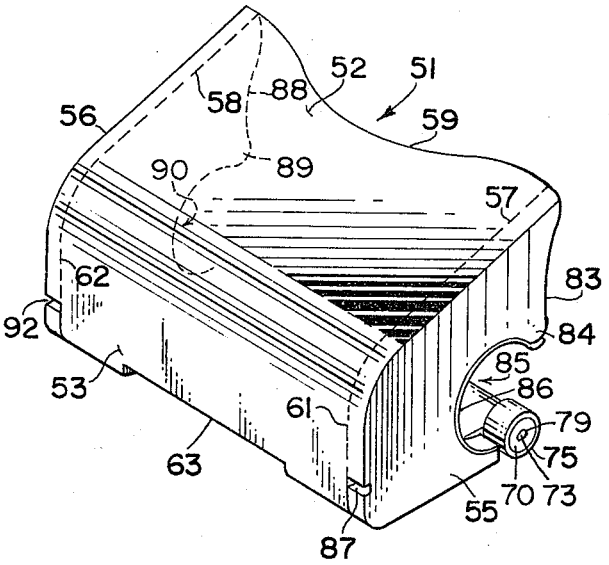
FIG. 7 is a perspective view of a modification of the invention illustrated in FIG. 1.
Figure 8:
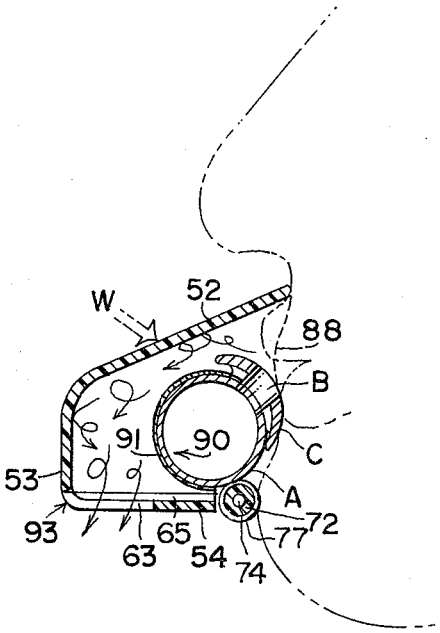
FIG. 8 is a sectional view of the modification taken on line 7—7 of FIG. 9 with a flute shown in cross section and a human outline of a face shown in phantom.
Figure 9:
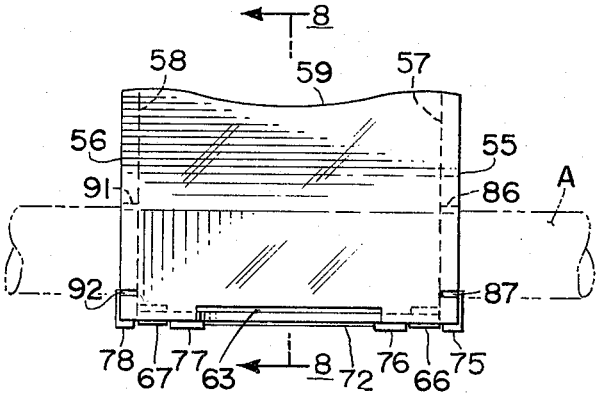
FIG. 9 is a front view of the modification illustrated in FIG. 7 with a flute outline shown in phantom.
Figure 10:
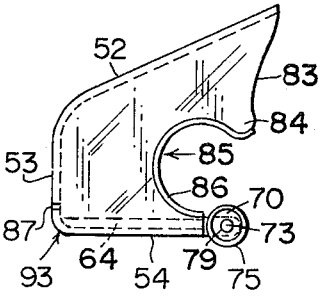
FIG. 10 is a left side view of the modification.
Figure 11:
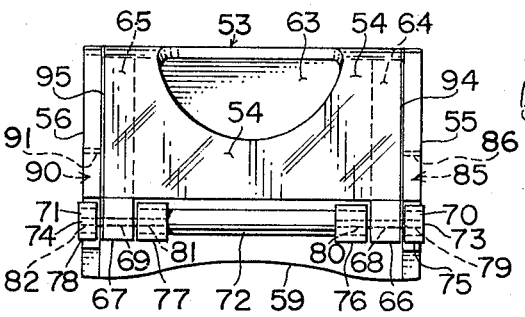
FIG. 11 is a bottom view of the modification.
Figure 12:
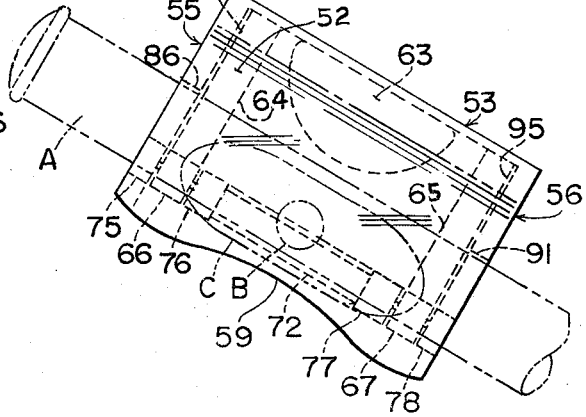
FIG. 12 is a top view of the modification with a flute outline shown in phantom to illustrate the position of the embouchure hole plate in relation to the modification.

A modification of the preferred embodiment is shown in FIGS. 7–12 inclusive and is designated by the reference numeral 51. Wind shield 51 is similar to wind shield 1 except for the following: (1) It has a larger diameter semicircular vent opening. (2) It does not have vent slits. (3) The sides of the top member and the bottom member are straight, not tapered. Since the bottom member 54 has a larger surface area, a larger diameter semicircular vent opening can be made without actually diminishing or weakening the remaining portion. The larger diameter semicircular vent opening 63 eliminates the need for vent slits.

Wind shield 51 includes a top member 52, a front member 53, a bottom member 54, a left plate 55, and a right plate 56. Top member 52 inclues sides 57 and 58 and contour lip edge 59. Sides 57 and 58 are parallel to each other. Front member 53 includes sides 61 and 62. Sides 61 and 62 are parallel to each other.

Bottom member 54 includes vent opening 63, sides 94 and 95, stiffeners 64 and 65, leaves 66 and 67, cylindrical openings 68 and 69, left wheel 70, right wheel 71, middle wheel 72, left axle 73, right axle 74, and protector rings 75, 76, 77, and 78. Protector ring 75 encircles left wheel 70; protector ring 78 encircles right wheel 71; and protector rings 76 and 77 encircle the end portions of middle wheel 72.

An end portion of left axle 73 is secured within the central opening 70 of left wheel 70. An end portion of right axle 74 is secured within the central opening 82 of right wheel 71. Middle wheel 72 has cylindrical openings 80 and 81 in its end portions.

Left axle 73 passes through cylindrical openings 68 and 80. Right axle 74 passes through cylindrical openings 69 and 81. Left axle 73 and right axle 74 serve as axles for the three wheels 70, 71, and 72.

Stiffeners 64 and 65 are secured to the top of bottom member 54 and at its side borders. Leaves 66 and 67 are secured to the portions of stiffeners 64 and 65, respectively, which extend beyond the rear edge of bottom member 54. Stiffener 64 and leaf 66 form cylindrical opening 68. Stiffener 65 and leaf 67 form cylindrical opening 69.

Top member 52 is joined to front member 53 by a bend. Front member 53 is joined to bottom member 54 by a bend 93, which also serves as a hinge for bottom member 54.

Left plate 55 includes a facing edge 83, a bulge 84, holding portion 85, lining 86, and slit 87. Right plate 56 includes a facing edge 88, a bulge 89, holding portion 90, lining 91, and slit 92.

Facing edges 83 and 88 provide a comfortable fit when the device is pressed or placed against the mouth area. Bulges 84 and 89 aid in retaining barrel A in holding portions 85 and 90. Holding portion 85 is greater in diameter than holding portion 90 in order to compensate for the slightly conical shape of barrel A. Both holding portions 85 and 90 serve to receive barrel A in a snug and comfortable fit. Linings 86 and 91 serve to prevent abrasion and scratching of the silver finish of barrel A.

Slits 87 and 92 serve to stop capillary flow of liquid glue or cement from proceeding beyond the slits. They stop the capillary flow at a desired point to allow bottom member 54 to be free and moveable.

Left plate 55 is secured to sides 57 and 61. Right plate 56 is secured to sides 58 and 62. When glue or cement is used to secure left plate 55 and right plate 56 to the sides of top and front members, slits 87 and 92 allow the bottom member 54 to be free and moveable as they stop the capillary flow of the glue or cement at the slits. Bottom member 54 is free and moveable about bend 93. Slits 87 and 92 are located in a location which will allow the securing of left plate 55 and right plate 56 to the top member 52 and front member 53, but not to bottom member 54.

My preferred embodiment and its modification are fabricated out of a high quality acrylic plastic, such as the one sold under the trademark Plexiglas. However, any material which is lightweight, pliable, resilient, durable, and economical may be used. The axles are made of brass. Protector rings are made of soft vinyl tubing.

Top member, front member, and bottom member are made of a single piece of acrylic plastic. One end of front member is joined to top member by a bend and the other end of front member is joined to bottom member by a bend.

Top member is made of a length that it will extend from the upper lip area of a flutist at a downward angle to approximately ½" from the front barrel A. Front member is made of a length that it will extend to the bottom of barrel A, approximately an inch or so. Bottom member is made of such a length that it will extend to the rear of barrel A, approximately 1¼". Since my invention may be used by most of the flute family, no specific set of measurements are given as the dimensions will vary depending which flute my device will be an accessory to.

Vent slits are made at a downward angle to allow for the passage of air and sound through and out of the device while at the same time preventing the entrance of the wind. I have found that the intonation remains true and constant with the use of vent slits.

Semicircular vent opening serves the same purpose as the vent slits. It also serves to lessen the tension in the bottom member. Without its presence the tension would be greatly increased and the chance of the bottom member breaking at the bend would be more than likely. It weakens or lessens the tension simply by diminishing the surface of the bend. In the modification, the larger diameter semicircular vent opening is more than adequate in providing the necessary channel for the air and sound to flow smoothly out of the device. The intonation remains true and constant and is not affected by the lack of vent slits.

Bottom member provides the tension necessary to achieve a clamp effect in retaining the device on a flute. This results because the distance between the bulges and the wheels is slightly less than the diameter of the barrel of a flute and because of the inherent pliable characteristic of acrylic plastic, such as Plexiglas.

Stiffeners are capillary cemented to the bottom member. This doubles the thickness of the areas involved and also strengthens the bottom member. The stiffeners extend approximately ¼" beyond the rear edge of bottom member. Leaves of the same thickness as the bottom member and rectangular in shape are capillary cemented beneath the jutting ¼" edge portions of the stiffeners.

Wheels are situated at the rear outermost edge of the bottom member. Their primary function is to provide additional insurance against the possibility of scratching the silver finish of a flute when the device is attached or detached. Left and right wheels are made of acrylic plastic, such as Plexiglas and are of identical lengths. Protector rings cover the wheels and serve as an anti-friction agent and facilitate the processes of attachment and detachment of the device to and from a flute. They also provide a protective cover over the wheels that further insures against the possbility of scratching or marring the silver finish of a flute barrel.

Brass are used for the axles because of its anit-rust and long lasting quality. One end of a small brass tube is slightly reamed to cause a slight flare. The unreamed end is passed through the central opening of the outer wheel until the reamed end is reached. The unreamed end is then passed through the cylindrical openings in stiffener-leaf and in middle wheel. A small amount of glue or cement is deposited in the cylindrical opening of the middle wheel prior to the unreamed end being passed through the cylindrical opening. When the bonding action takes hold, the axle is secured to the wheels. This process is repeated for the other axle. I call the wheels, protective rings, and axles a "rolling pin" assembly because of their resemblance to one.

Contour lip edge enables the flutist to bring the device as close to the lips, even to the point of contact, without any undue discomfort. Contour lip edge operates with the facing edges to touch and cover the mouth area to provide maximum protection against wind entering from the top as well as the sides of the mouth.

Left and right plates are secured to the top and front members by glue, cement or other bonding agent. I use a liquid solvent known as EDC or Ethylene Dichloride to secure the left and right plates to the sides of the top and front members of my preferred embodiment and its modification. Note that the slits located near the lower bend stop the capillary flow of the liquid cement from proceeding beyond the slits. There is a slit between the sides of the bottom member and left and right plates.

The lining is made of velour, felt, or similar type material. Any material may be used which will lessen the possibility of scratching or marring the silver finish of a flute barrel.

My invention is attached to barrel A in the following manner: (1) Hold barrel A in a horizontal position with embouchure hole plate C facing upward. (2) Aline wind shield with embouchure hole plate C so that its rear is facing barrel A and so that its left and right plates are evenly spaced from the embouchure hole plate C. (3) Bring wind shield into contact with barrel A. (4) Push wind shield towards barrel A until barrel A is snugly positioned in the lined holding portions of left and right plates.

The distance between the bulges and the wheels is slightly less than the diameter of barrel A. As wind shield is pushed towards barrel A, bottom member is pushed downward. See FIG. 4. Then barrel A is rolled by the wheels into the lined holding portions. When barrel A is snugly positioned in the lined holding portions, bottom member resumes its original position. See FIG. 2. In its original position, the bottom member confines and holds barrel A within the lined holding portions. The bulges also aid in retaining barrel A in the lined holding portions. If it is deemed desirable, the bulges may be eliminated provided the entrance point to the lined holding portions is made slightly smaller than the diameter of barrel A.

The wind shield is detached from barrel A by pulling the wind shield away from barrel A until barrel A is no longer in contact with the wind shield. As the wind shield is pulled away from barrel A, bottom member is pushed downward and barrel A is rolled by the wheels out of the lined holding portions.

The flute is the only instrument whose tone results from the passing of a column of air across an open and exposed embouchure hole or aperture. All other instruments produce tones that are the result of an unbroken and unexposed column of air flowing from the lungs directly in, through and out of the instruments. To produce a sound on a flute, air is blown directly across the embouchure hole in a flat stream made by shaping the lips. When the column of air breaks against the sharp outer edge of the embouchure hole, half of the air passes into the embouchure hole and half of the air passes over it. See FIGS. 2 and 8. The half of the column of air that passes into the embouchure hole B causes the stationary column of air within the tube to pulse and vibrate down the tube's length. This action generates a sound, called an edge tone, pitched in proportion to the length of the tube.

Since the edge tone of a flute results from passing a column of air across an open and exposed embouchure hole, wind and other extraneous outdoor elemental factors affect a flutist's ability to perform naturally and normally outdoors. In addition, the elements can cause the lips to become dry and chapped. Any tone produced under adverse weather conditions would have characteristics and qualities far below the lowest acceptable standards. The sound would be thin, airy, shallow and hollow without depth and generally distorted. Since the flute is called upon to execute more solos, bits of solos and exposed passages than any other instrument in the band, one can readily see the detrimental effect that wind and other extraneous outdoor elemental factors can have upon a flutist's performance.

My invention shields the embouchure hole area from the wind and other extraneous outdoor elemental factors and allows a flutist to perform normally outdoors. In addition my invention prevents wind chapped lips during an outdoor performance by enveloping the mouth area of a flutist. Moreover, since my invention enables a flutist to produce normal tones regardless of adverse outdoor conditions, it is a pyschologically effective means of instilling confidence in a flutist whenever an outdoor performance is scheduled.

My invention is designed to touch and cover the mouth area of a flutist so as to provide maximum protection against wind entering from the top as well as the sides of the mouth. My invention is designed so that its side plates are as close to the sides of the embouchure hole plate C as possible without touching them. By keeping the side plates and sides of the embouchure hole plate C in close proximity, without touching each other, the device can be adjusted forward or backward of barrel A without scratching the sides of the embouchure hole plate C, which is silver plated or solid sterling silver. Another reason for the close proximity is that the side plates can more readily isolate the sides of the mouth against wind entry. A clearance of $\frac{1}{8}''$ between the side plates and the sides of the embouchure hole C is suggested. See FIGS. 6 and 12.

My preferred embodiments with the exception of the axles and protector rings are made out of a high quality plastic. The axles are made of brass. Protector rings are made of soft vinyl tubing. The use of these materials for my preferred embodiments results in a flute accessory which lightweight, attractive, transparent, economical, and durable. My preferred embodiments can be readily attached to the mouthpiece of a flute whenever outdoor conditions warrant their use. My preferred embodiments will provide a protective shield around the embouchure hole area of a flute and will enable a flutist to produce normal tones regardless of adverse outdoor conditions.

My invention will serve as a psychological aid to beginning flutists by boosting their confidence. My invention will aid the long suffering flutist in most outdoor situations by protecting the vital tone production area from the onslaught of buffeting elements, especially the wind. My invention will be a boon to flutists.

Although but two embodiments of the invention have been disclosed and described herein, it is obvious that many changes may be made in the size, shape, arrangements, color and detail of the various elements of the invention without departing from the scope of the novel concepts of the present invention.

I claim as my invention:

1. A wind shield for a flute-type instrument comprising a top member, a front member, a bottom member, a left plate, and a right plate; the top member is joined to the front member by a bend; the front member is joined to the bottom member by a bend; left and right plates are secured to the sides of the top and front members; bottom member has a vent opening near its juncture with the front member; the left and right plates each have a facing edge and a holding portion; the facing edges of the left and right plates and the free end of the top member are shaped to provide a comfortable fit when the wind shield is placed against the face of a flutist; the left and right plates are spaced at a preselected distance from the embouchure hole plate of a flute; holding portions of the left and right plates have a diameter which will accommodate the barrel of a flute in a snug and comfortable fit; and means to retain the barrel of a flute within the holding portions.

2. The wind shield of claim 1, wherein the front member has a preselected number of slits which are inclined in a downward direction.

3. The wind shield of claim 1, wherein the means to retain the barrel of a flute within the holding portions include a rolling pin assembly located at the end of the bottom member and the bend at the juncture of the front and bottom members which acts as a hinge; the rolling pin assembly includes a left wheel, a right wheel, a middle wheel, a left axle, and a right axle; the left axle is pivotally connected to the left wheel and the left end portion of the middle wheel; the right axle is pivotally connected to the right wheel and the right end portion of the middle wheel; and the left axle and the right axle are on the same axis.

4. The wind shield of claim 3, wherein the left and right plates each have a bulge located between its facing edge and its holding portion to aid in the retention of the barrel of a flute.

5. The wind shield of claim 4, wherein the holding portions are lined with a material which will prevent abrasion and scratching of the barrel of a flute.

6. The wind shield of claim 5, wherein the wheels are covered with an anti-friction material which will facilitate the processes of attachment and detachment of the wind shield to or from a flute and which will prevent abrasion and scratching of the barrel of a flute.

7. The wind shield of claim 6, wherein the front member has a preselected number of slits which are inclined in a downward direction.

8. The wind shield of claim 7, wherein the bottom member has two stiffeners secured to its top and side borders; the stiffeners extend beyond the rear edge of the bottom member; leaves are secured to the extended portions of the stiffeners; the stiffeners and leaves form two cylindrical openings which are on the same axis as the axis the left and right axles are on; and the left axle passes through one of the cylindrical openings while the right axle passes through the other cylindrical opening.

9. The wind shield of claim 8, wherein the left and right plates each has a slit located at its lower front end for the purpose of stopping the capillary flow of a liquid glue or cement from proceeding beyond the slit when the left and right plates are secured to the top and front members.

10. The wind shield of claim 8, wherein the top, front, and bottom members and the left and right plates are made of plastic; axles are made of brass; holding portions are lined with velour; and the wheel covering material is made of soft vinyl tubing.

* * * * *